US006128875A

United States Patent [19]

Quaintance

[11] Patent Number: 6,128,875

[45] Date of Patent: Oct. 10, 2000

[54] BI-DIRECTIONAL DOOR ROOM ARRANGEMENT

[75] Inventor: Dennis W. Quaintance, Greensboro, N.C.

[73] Assignee: Quaintance Weaver Hotels, L.L.C., Greensboro, N.C.

[21] Appl. No.: 09/158,929

[22] Filed: Sep. 22, 1998

[51] Int. Cl.[7] ..... E04B 1/34

[52] U.S. Cl. ..... 52/234; 52/236.2; 49/138

[58] Field of Search ..... 49/138; 52/65, 52/71, 234, 236.1, 236.2, 261

[56] References Cited

U.S. PATENT DOCUMENTS

| | | | |
|---|---|---|---|
| 2,200,934 | 5/1940 | Platt et al. | 52/236.2 X |
| 2,649,625 | 8/1953 | Johnson | 52/236.2 X |
| 2,820,241 | 1/1958 | Schlage | 49/138 X |
| 3,114,541 | 12/1963 | Coffey | 49/138 X |
| 3,750,356 | 8/1973 | Morse | 52/234 X |
| 4,718,205 | 1/1988 | Taylor | 52/234 X |
| 5,070,661 | 12/1991 | Lo Guidici | 52/234 X |
| 5,845,692 | 12/1998 | Kellem et al. | 160/118 |

FOREIGN PATENT DOCUMENTS

| | | | |
|---|---|---|---|
| 817036 | 7/1949 | Germany | 52/234 |
| 632214 | 1/1962 | Italy | 52/234 |
| 221441 | 9/1924 | United Kingdom | 52/234 |

*Primary Examiner*—Richard Chilcot
*Attorney, Agent, or Firm*—Rhodes, Coats & Bennett, L.L.C.

[57] ABSTRACT

A room arrangement for dividing and providing privacy between adjacent living areas in a hotel room, apartment or other similar facility. The room arrangement includes a first room or hallway and an adjoining second room, such as a dressing room with an attached closet or storage area. A bi-directional door is positioned between the first room and the second room. The bi-directional door is selectively positionable between a first position for providing a partition between the second room and the storage area and a second position providing a partition between the first room and the second room. A "two way" catch mechanism maintains the bidirectional door in one of the first and the second positions. In the preferred embodiment, a third room, such as a bathroom, adjoins the second room wherein when the bi-directional door is positioned in the second position, the third room and the second room and the storage area are separated from the first room. A conventional "one way" door may separate the dressing room from the bathroom.

40 Claims, 4 Drawing Sheets

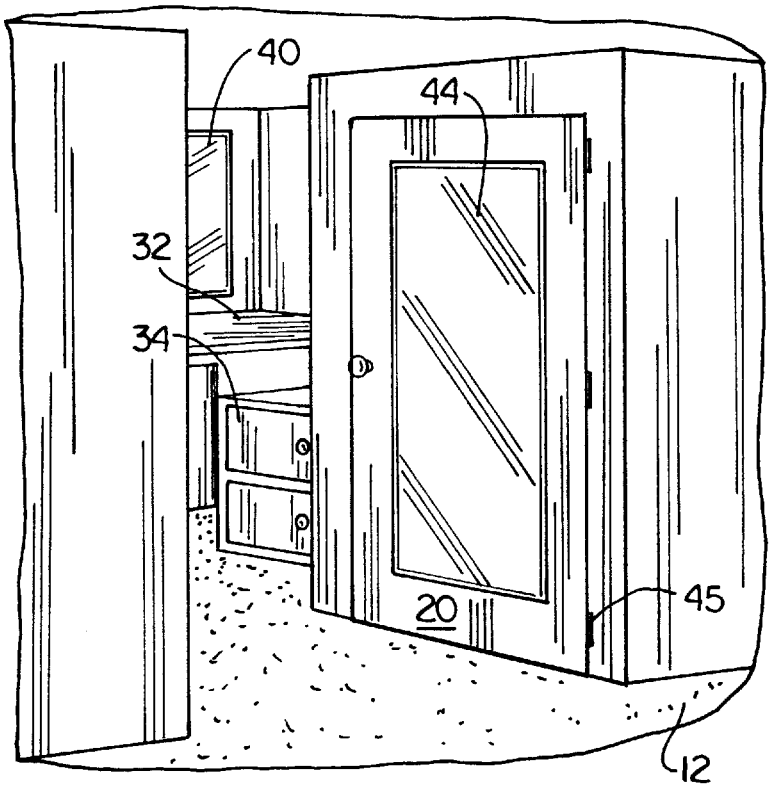
FIG. 2
FIG. 3
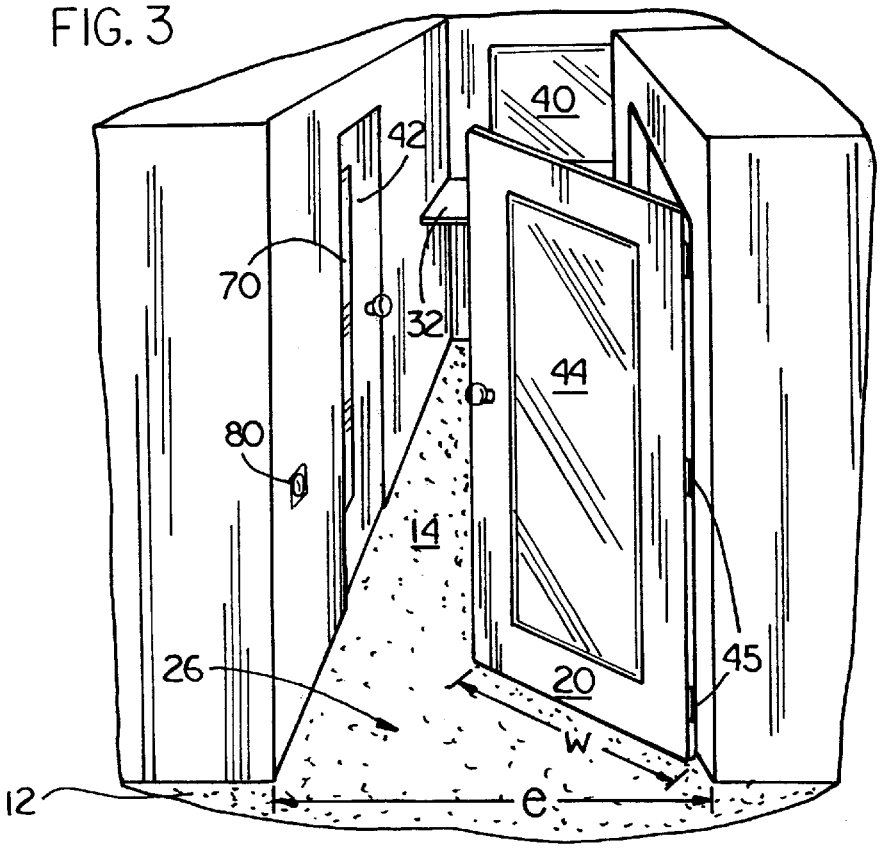

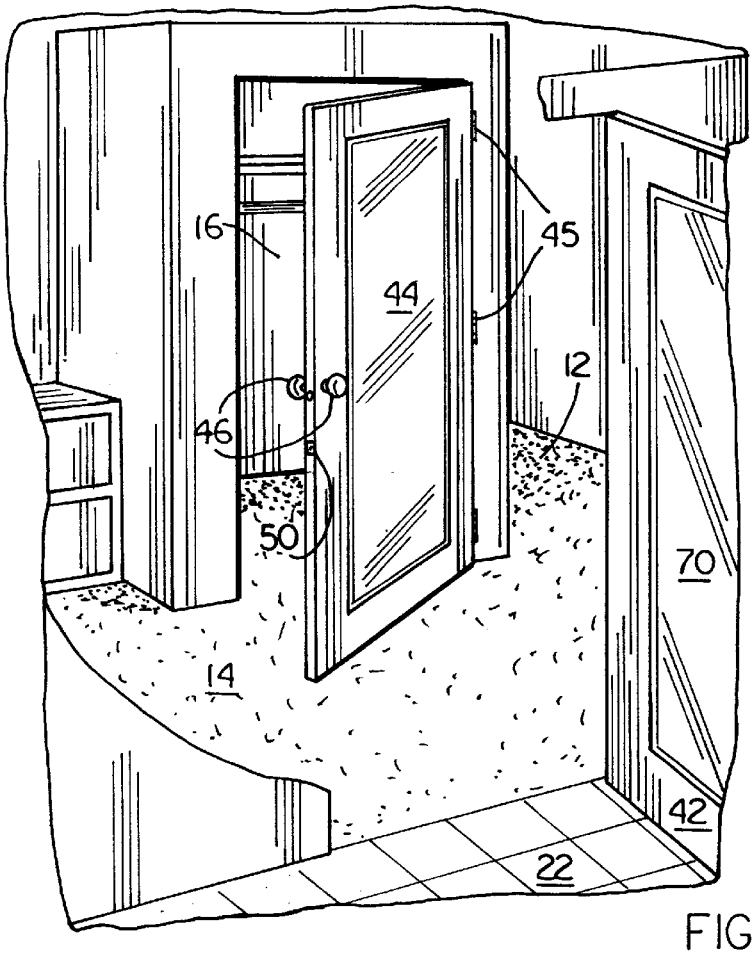
FIG. 4
FIG. 5
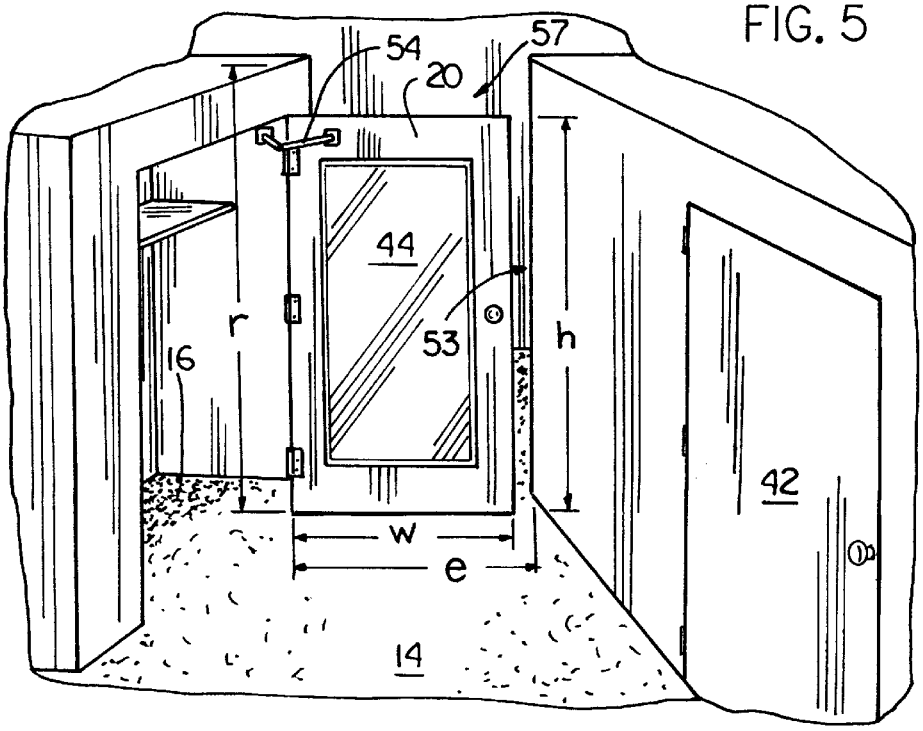

BI-DIRECTIONAL DOOR ROOM ARRANGEMENT

BACKGROUND OF THE INVENTION (1) Field of the Invention

The present invention relates generally to a room arrangement for partitioning adjacent living areas and, more particularly, to a room arrangement having a bi-directional door that is selectively positionable to partition adjacent rooms.

(2) Description of the Prior Art

The layout and design of room arrangements is always concerned with utilizing the limited amount of square footage that is allocated for the rooms. This is especially important in hotels, apartments, and other commercial facilities in which rooms are sized as small as possible while, at the same time, still trying to maintaining the comfort and feel of a larger, more spacious layout.

An effective room arrangement maximizes available square footage and provides a useable, comfortable room for the user. Within the room arrangement, privacy areas are needed for changing clothes, talking on the telephone, taking a shower, etc. Segregating areas for these activities requires interior walls and doorways which are often inefficient uses of space since the interior doorframes and doors occupy portions of the available square footage. Additionally, doorframes and doors are expensive and require skilled labor to install.

Previous attempts to provide additional privacy areas have had several drawbacks. For example, many of the prior art designs are cumbersome and not practical for the users, such as telescoping and inter-meshing doors, slidable walls, corresponding doors, and others. These devices are often only seen in more expensive private homes and are cost prohibitive for hotels and apartments. Additionally, they require extra maintenance, which commercial operations must avoid to remain profitable, to ensure the devices continue to operate effectively.

Thus, there remains a need for a new and improved room arrangement which utilizes an unique bi-directional door to partition adjacent areas of the room arrangement while, at the same time, does not reduce usable space or add additional construction or maintenance costs when compared to conventional door and frame construction.

SUMMARY OF THE INVENTION

The present invention is directed to a room arrangement for dividing and providing privacy between adjacent living areas in a hotel room, apartment or other similar facility. The invention converts an entryway and room into a private area thus creating additional value from the room arrangement. In the preferred embodiment, the room arrangement includes a first room or hallway and an adjoining second room, such as a dressing room with an attached closet or storage area. A bi-directional door is positioned between the first or main room and the second room. The bi-directional door is selectively positionable between a first position for providing a partition between the second room and the storage area and a second position providing a partition between the first room and the second room. A "two way" catch mechanism maintains the bi-directional door in one of the first and the second positions.

In the preferred embodiment, a third room, such as a bathroom, adjoins the second room wherein when the bi-directional door is positioned in the second position, the third room and the second room and the storage area are separated from the first room. A conventional "one way" door may separate the dressing room from the bathroom.

A doorstop arm may be mounted on the bi-directional door to control the swing distance of the bi-directional door to either assist or replace the catch. In addition, the bi-directional door may include a mirror on at least one of its front and backsides. In the preferred embodiment, the catch mechanism includes a roller knuckle for maintaining the bi-directional door in one of the first and the second positions. Also, the bi-directional door may further include a door handle attached to the bi-directional door to assist in opening and closing the door and a locking mechanism to lock the bi-directional door in one of the first and the second positions. Finally, the dressing room may include a sink, telephone, dresser, mirror, and counter.

Accordingly, one aspect of the present invention is to provide a room arrangement for dividing and providing privacy between adjacent areas. The room arrangement includes: (a) a first room; (b) a second room with an attached storage area, the second room adjoining the first room; and (c) a bi-directional door positioned between the first room and the second room, the bi-directional door being selectively positionable between a first position for providing a partition between the second room and the storage area and a second position providing a partition between the first room and the second room.

Another aspect of the present invention is to provide a room arrangement for utilizing usable space between a first room and a second room that adjoins the first room and includes an adjoining storage area. The improvement includes a bi-directional door selectively positionable between a first position providing a partition between the second room and the storage area, and a second position providing a partition between the first room and the second room, the bi-directional door further including a catch mechanism for maintaining the bi-directional door in one of the first and the second positions.

Still another aspect of the present invention is to provide a room arrangement for dividing and providing privacy between adjacent areas. The arrangement includes: (a) a first room; (b) a second room with an attached storage area, the second room adjoining the first room; (c) a bi-directional door positioned between the first room and the second room, the bi-directional door being selectively positionable between a first position for providing a partition between the second room and the storage area and a second position providing a partition between the first room and the second room; (d) a catch mechanism for maintaining the bi-directional door in one of the first and the second positions; and (e) a third room adjoining the second room wherein when the bi-directional door is positioned in the second position, the third room and the second room and the storage area are separated from the first room.

These and other aspects of the present invention will become apparent to those skilled in the art after a reading of the following description of the preferred embodiment when considered with the drawings.

BRIEF DESCRIPTION OF THE DRAWINGS

FIG. 2 is a perspective view of the bi-directional door positioned to separate the second room from the storage area;

FIG. 3 is a perspective view of the second room and adjoining third room;

FIG. 4 is a perspective view of the bi-directional door positioned between the storage area, the first room, and the second room;

FIG. 5 is a perspective view of the bi-directional door separating the first room from the second room.

DESCRIPTION OF THE PREFERRED EMBODIMENTS

Figure 1:
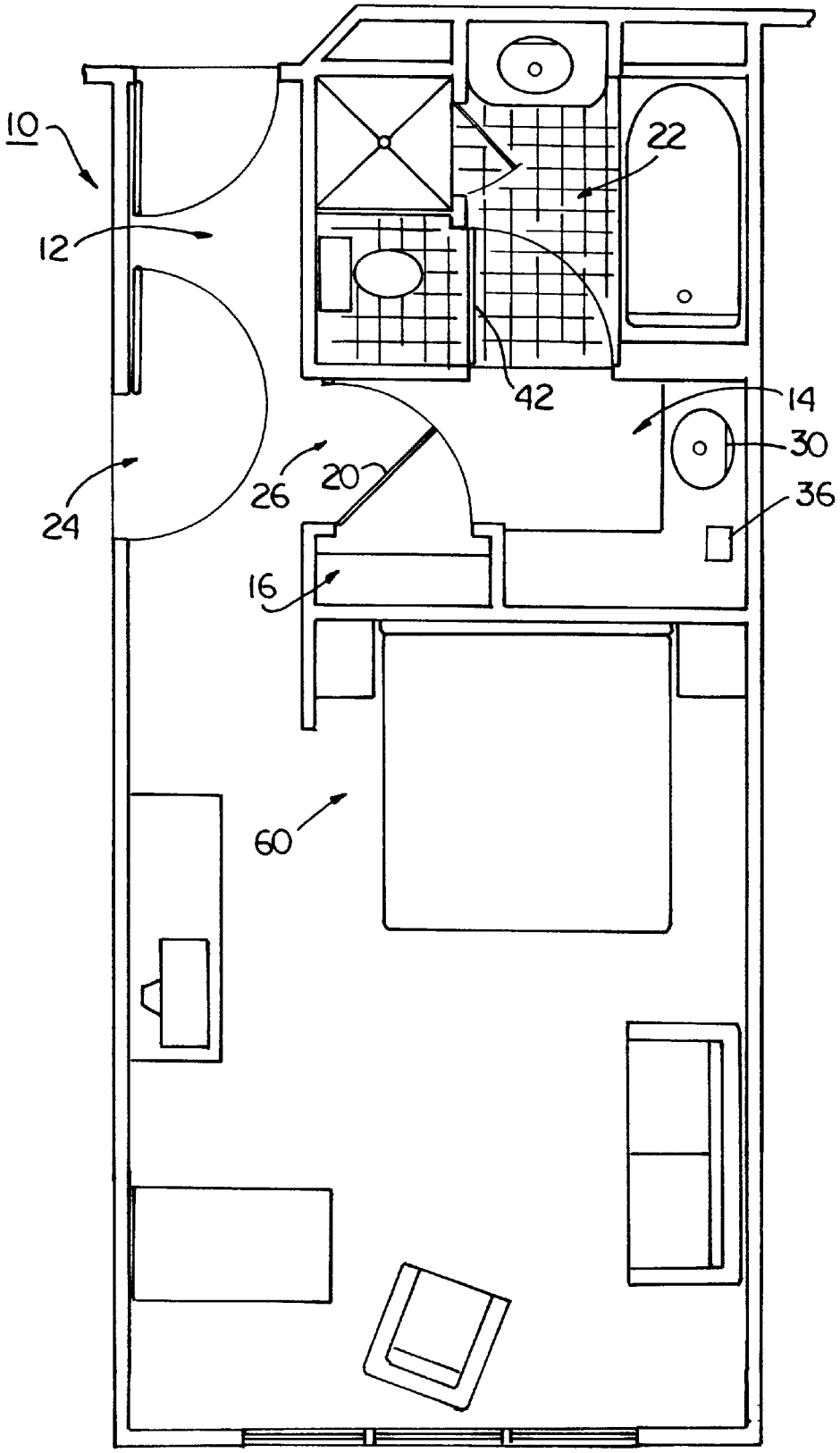
FIG. 1 is a schematic illustration of a room arrangement having a bi-directional door constructed according to the present invention.

In the following description, like reference characters designate like or corresponding parts throughout the several views. Also in the following description, it is to be understood that such terms as "forward," "rearward," "left," "right", "upperwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a room arrangement, generally designated 10, is shown constructed according to the present invention. The room arrangement includes a first room 12 which adjoins a second room 14. The second room 14 further includes a storage area 16. A bi-directional door 20 swings between the first room 12, second room 14, and storage area 16 to partition these areas. In the preferred embodiment, a third room 22 further adjoins the second room. The room arrangement of the present invention can be incorporated into various types of space. However, in the preferred embodiment, the room arrangement is for a hotel room having a bathroom and adjacent dressing room to provide for maximizing the available square footage of the hotel room.

The first room 12 is positioned adjacent with and connected to the second room, as illustrated in FIG. 1. In one preferred embodiment, the first room is an outer hallway which includes a doorway 24 leading to an adjacent living area 60. It will be understood that the first room 12 may have a number of configurations and layouts provided it is adjacent and connected to the second room.

An entryway 26 connects the first room with the second room. The second room 14 is preferably sized to allow a person to store items such as clothing and other personal belongings and is sufficiently sized to allow one to change clothes, brush teeth, apply makeup, etc. The second room 14 may include a counter 32, a sink 30, a mirror 40 preferably located on a wall opposite the entryway, a dresser 34 for storing clothes or other items, and a phone 36. The second room may further include other items similar in nature to these listed.

A storage area 16 is connected to the second room 14. In one preferred embodiment, the storage area is a closet for allowing the hotel guest to hang clothes and store items which are then readily retrievable when dressing or otherwise preparing oneself in the second room. Alternatively, the storage area could be another room, such as a second bathroom.

The third room 22 is connected with the second room. A separate, conventional "one way" door 42 partitions the second room from the third room for providing additional privacy and separation. The door 42 may further include a mirror 70 on at least one side for viewing by the guest. In one preferred embodiment, illustrated in FIG. 1, the third room 22 is a bathroom which may include a toilet, shower, sink, and tub. It is understood that the third room can be used for a number of purposes including but not limited to a bedroom, kitchen, or library.

The bi-directional door 20 is positioned to swing and provide a partition between the first room 12, second room 14, and storage area 16. Hinges 45 are provided on the outside edge opposite the storage area 16 provide for the door to swing through these areas. The bi-directional door 20 may further include a mirror 44 positioned on one or both sides for helping guests to get dressed as illustrated in FIGS. 3 and 5.

A doorknob 46 extends through to both sides of the bi-directional door to allow for opening and closing between a first position which partitions the storage area 16 from the second room 14 and a second position partitioning the first room 12 from the second room 14. The doorknob 46 may further be equipped with a locking mechanism to lock the bi-directional door in either the first or the second position for additional privacy and security.

In the preferred embodiment, a roller knuckle 50 is attached to the bi-directional door edge for maintaining the door in the first or second position. The roller knuckle 50 includes an outwardly biasing member which mates with a fitting or receptacle in the doorframe. The roller knuckle 50 biases inward as the bi-directional door swings through the doorframes and then biases outward into the fitting or receptacle in the doorframes to maintain the door.

Figure 6:
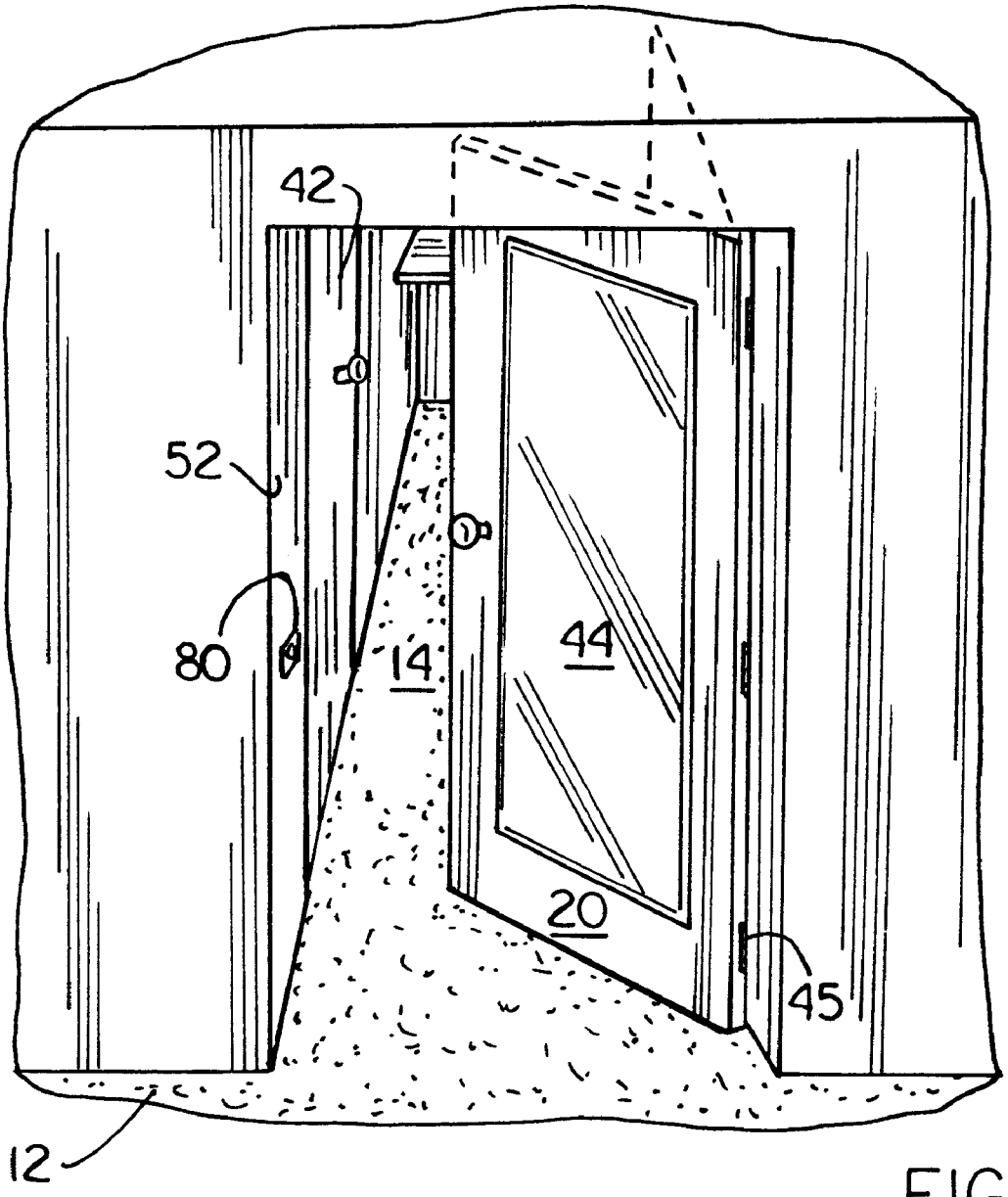
FIG. 6 is a perspective view of the bi-directional door positioned between the first room and the second room.

In one embodiment illustrated in FIG. 6, a doorframe 52 is positioned in the entryway 26. In this embodiment, the doorframe 52 and bi-directional door 20 encompass the entire entryway section from the ceiling to the floor of the room.

In an alternative embodiment illustrated in FIG. 3, the width w of the bi-directional door 20 is approximately equal to the entryway width e. The bi-directional door 20 swings between a first position partitioning the storage area 16 from the second room 14 to a second position partitioning the first room 12 from the second room 14. As the width the door is approximately equal to the entryway width, there is no need for a separate doorframes as the door swings directly against the entryway wall. A fitting or receptacle 80 is positioned on the entryway wall for capturing the roller knuckle or doorknob from the bi-directional door to maintain the door in the second position.

Another embodiment illustrated in FIG. 5 includes the bi-directional door width w be less than the entryway width e. When the door is in the second position to partition the first room from the second room, the bi-directional door does not extend to the entryway wall but rather provides an opening 53. This embodiment allows for a user to grasp the edge of the bi-directional door and swing it from a first position to a second position without the risk of pinching their hands between the edge of the door and the entryway wall. A doorstop 54 is mounted on the door to help prevent the door from opening beyond a predetermined distance. In this embodiment, the height of the door h is less than the height of the room r to provide a gap 57 between the ceiling and the top of the door. Although there are gaps between the top and sides of the door when the first room is partitioned from the second room, there will still be an increased amount of privacy to allow a person to get dressed, talk on the phone, or undertake some other private activity.

In use, the bi-directional door 20 can be selectively maintained in either position. The door may partition the storage area 16 from the second room 14 providing for the first and second rooms to be accessible. When additional privacy is required, the bi-directional door 20 can be positioned to partition the first room from the second room. This arrangement allows space within the second room for a person to change clothes as the storage area is accessible. The mirror 40 and one of mirrors 44 are positioned on opposite walls of the second room for the user to view their clothes and/or makeup while getting dressed. The third room 22 can be either connected with the second room or independently isolated by closing door 42 to partition the two rooms. When privacy is no longer needed, the bi-directional door 20 can be repositioned thereby allowing access and communication with the other areas of the room arrangement.

Certain modifications and improvements will occur to those skilled in the art upon a reading of the foregoing description. For example, while the catch mechanism in the preferred embodiment is a roller knuckle, it is expected that other "two way" catches, such as throw bolts, pins and magnetic latches could be adapted for use within the scope of the present invention. It should be understood that all such modifications and improvements have been deleted herein for the sake of conciseness and readability but are properly within the scope of the following claims.

I claim:

1. A room arrangement for dividing and providing privacy between adjacent areas, said room arrangement comprising:

(a) a first room;

(b) a second room with an attached storage area, said second room adjoining said first room; and (c) a bi-directional door positioned between said first room and said second room, said bi-directional door being selectively positionable between a first position for providing a partition between said second room and said storage area and a second position providing a partition between said first room and said second room.

2. The apparatus of claim 1, further including a third room adjoining said second room wherein when said bi-directional door is positioned in said second position, said third room and said second room and said storage area are separated from said first room.

3. The apparatus of claim 2, wherein said third room is a bathroom.

4. The apparatus of claim 2, wherein a second door separates said second room from said third room, said door being selectively positionable for isolating said third room from said second room.

5. The apparatus of claim 4, wherein said second door swings open into said third room.

6. The apparatus of claim 1, wherein said room arrangement is a hotel room.

7. In a room arrangement for utilizing usable space between a first room and a second room that adjoins the first room and includes an adjoining storage area, the improvement comprising a bi-directional door selectively positionable between a first position providing a partition between said second room and said storage area, and a second position providing a partition between said first room and said second room, said bi-directional door further including a catch mechanism for maintaining said bi-directional door at said first and said second positions.

8. The apparatus of claim 7, wherein said second room includes an entryway adjacent to said bi-directional door, wherein the width of said entryway is substantially equal to the width of said bi-directional door.

9. The apparatus of claim 8, wherein said entryway includes a doorframe for housing said bi-directional door in said second position.

10. The apparatus of claim 7, wherein said second room includes an entryway adjacent to said bi-directional door, wherein the width of said entryway is greater than the width of said bi-directional door providing for an opening between said bi-directional door and said entryway when said bi-directional door is in said second position.

11. The apparatus of claim 10, further including a doorstop arm mounted on said bi-directional door to control the swing distance of said bi-directional door.

12. The apparatus of claim 7, wherein said bi-directional door includes a mirror on at least one of its front and back sides.

13. The apparatus of claim 7, wherein said storage area includes a doorframe for housing said bi-directional door in said first position.

14. The apparatus of claim 7, wherein said storage area is a fourth room.

15. The apparatus of claim 7, wherein said storage area is a closet.

16. The apparatus of claim 7, wherein said catch mechanism includes a roller knuckle for maintaining said bi-directional door in one of said first and said second positions.

17. The apparatus of claim 7, wherein said bi-directional door further includes a door handle.

18. The apparatus of claim 17, wherein said door handle includes a locking mechanism to lock said bi-directional door in one of said first and said second positions.

19. The apparatus of claim 7, wherein said second room includes items selected from the group consisting of a sink, telephone, dresser, mirror, and counter.

20. The apparatus of claim 7, wherein said first room is a hallway leading from an outer door to the interior of said room arrangement.

21. The apparatus of claim 20, further including a fourth room connected to said first room.

22. A room arrangement for dividing and providing privacy between adjacent areas, said room arrangement comprising:

(a) a first room;

(b) a second room with an attached storage area, said second room adjoining said first room;

(c) a bi-directional door positioned between said first room and said second room, said bi-directional door being selectively positionable between a first position for providing a partition between said second room and said storage area and a second position providing a partition between said first room and said second room;

(d) a catch mechanism for maintaining said bi-directional door in one of said first an d said second positions; and (e) a third room adjoining said second room wherein when said bi-directional door is positioned i n said second position said third room and said second room and said storage area are separated from said first room.

23. The apparatus of claim 22, wherein said third room is a bathroom.

24. The apparatus of claim 22, wherein a second door separates said second room from said third room, said second door being selectively positionable for isolating said third room from said second room.

25. The apparatus of claim 24, wherein said second door swings open into said third room.

26. The apparatus of claim 22, wherein said room arrangement is a hotel room.

27. The apparatus of claim 22, wherein said second room includes an entryway adjacent to said bi-directional door, wherein the width of said entryway is substantially equal to the width of said bi-directional door.

28. The apparatus of claim 27, wherein said entryway includes a doorframe for housing said bi-directional in said second position.

29. The apparatus of claim 22, wherein said second room includes an entryway adjacent to said bi-directional door, wherein the width of said entryway is greater than the width of said bi-directional door providing for an opening between said bi-directional door and said entryway when said bi-directional door is in said second position.

30. The apparatus of claim 29, further including a doorstop arm mounted on said bi-directional door to control the swing distance of said bi-directional door.

31. The apparatus of claim 22, wherein said bi-directional door includes a mirror on at least one of its front and back sides.

32. The apparatus of claim 22, wherein said storage area includes a doorframes for housing said bi-directional door in said first position.

33. The apparatus of claim 22, wherein said storage area is a fourth room.

34. The apparatus of claim 22, wherein said storage area is a closet.

35. The apparatus of claim 22, wherein said catch mechanism includes a roller knuckle for maintaining said bi-directional door at said first and said second positions.

36. The apparatus of claim 22, wherein said bi-directional door further includes a door handle.

37. The apparatus of claim 36, wherein said door handle includes a locking mechanism to lock said bi-directional door in one of said first and said second positions.

38. The apparatus of claim 22, wherein said second room includes items selected from the group consisting of a sink, telephone, dresser, mirror, and counter.

39. The apparatus of claim 22, wherein said first room is a hallway leading from an outer door to the interior of said room arrangement.

40. The apparatus of claim 39, further including a fourth room connected to said first room.

* * * * *